US008387925B2

(12) United States Patent
Aisa et al.

(10) Patent No.: US 8,387,925 B2
(45) Date of Patent: Mar. 5, 2013

(54) TRACK CIRCUIT

(75) Inventors: Pier Alessandro Aisa, Granarolo Dell'Emilia (IT); Andrea Giovannucci, Bologna (IT)

(73) Assignee: Alstom Ferroviaria S.p.A, Savigliano (CN) (IT)

( * ) Notice: Subject to any disclaimer, the term of this patent is extended or adjusted under 35 U.S.C. 154(b) by 295 days.

(21) Appl. No.: 12/968,681

(22) Filed: Dec. 15, 2010

(65) Prior Publication Data

US 2011/0147535 A1 Jun. 23, 2011

(30) Foreign Application Priority Data

Dec. 21, 2009 (EP) ..... 09425518

(51) Int. Cl.
*B61L 25/02* (2006.01)

(52) U.S. Cl. ..... 246/34 B; 246/34 A; 246/34 R; 246/122 R

(58) Field of Classification Search ..... 246/121, 246/249, 34 R, 34 A, 34 B, 34 CT, 122 R; 701/19, 20
See application file for complete search history.

(56) References Cited

U.S. PATENT DOCUMENTS 3,359,416 A * 12/1967 Wilcox ..... 246/34 CT
3,526,378 A * 9/1970 Thorne-Booth ..... 246/34 R
3,821,544 A * 6/1974 Matty ..... 246/34 CT
3,868,075 A * 2/1975 Blazek et al. ..... 246/34 CT
4,026,506 A * 5/1977 Bourke et al. ..... 246/34 R
4,723,739 A * 2/1988 Franke ..... 246/34 C
5,330,135 A * 7/1994 Roberts ..... 246/34 R
5,470,034 A * 11/1995 Reeves ..... 246/122 R
5,720,454 A * 2/1998 Bachetti et al. ..... 246/34 R
6,102,340 A * 8/2000 Peek et al. ..... 246/121
7,017,864 B2 * 3/2006 McAllister ..... 246/34 R
2005/0075765 A1 * 4/2005 Oguma et al. ..... 701/19
2006/0249631 A1 11/2006 Vehar et al.
2011/0174934 A1 * 7/2011 Kikuchi et al. ..... 246/122 R

FOREIGN PATENT DOCUMENTS

| | | |
|---|---|---|
| DE | 3242199 | 6/1984 |
| EP | 0771711 | 5/1997 |
| EP | 2090491 | 8/2009 |
| WO | 9947404 | 9/1999 |

OTHER PUBLICATIONS

EPO, European Search Report, Jun. 25, 2010.

* cited by examiner

*Primary Examiner* — Mark Le
(74) *Attorney, Agent, or Firm* — Themis Law

(57) ABSTRACT

A track circuit for railway systems or the like includes a track segment of predetermined length electrically insulated from an adjacent track segment by an electric joint, which includes a conductor and forms two loops arranged in a longitudinal S-shape within the space between the rails. Units are provided that transmit and receive electric signals and that are operatively coupled with the electric joints. The transmitting/receiving units include a unit transmitting and receiving a high-frequency signal to detect a train on the a track segment, and a unit transmitting and receiving a low-frequency signal which provides the carrier encoded with information to be transmitted to a train-based receiving unit. Units are further provided that enable/disable the high-frequency signal transmitting/receiving units, and units that enable/disable the low-frequency signal transmitting/receiving units, which are alternately actuated. The electric joint includes an internal impedance disposed between the two loops.

11 Claims, 6 Drawing Sheets

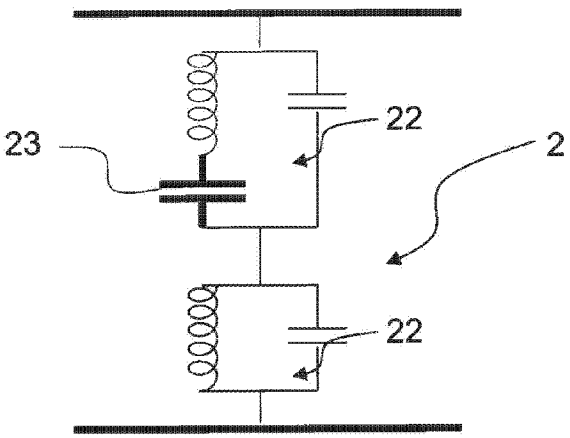
Fig. 3b
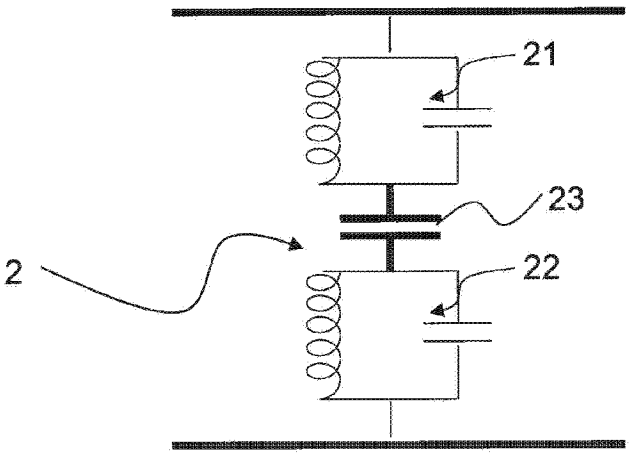
Fig. 3a
Fig. 3

TRACK CIRCUIT

FIELD OF THE INVENTION

The present invention relates to a track circuit for railway systems or the like, which includes a track segment of predetermined length, electrically insulated from adjoining segments by electric joints, each comprising a conductor. The electric joints connect together the rails at the ends of the track segments and form two curves arranged in an S-shape, in the space between the rails, with the S lying in the direction of the track axis and having arms extending in the direction of the track, arranged along the inner sides of the rails.

Means that transmit and receive electric signals are also provided, which are associated with the electric joints, so that one joint is alternately connected with the transmitting or receiving means of its track segment and the transmitting or receiving means of the adjacent track segment, and each electric joint forms the start of its track segment and the end of the previous track segment.

The transmitting and receiving means also include ground-based fixed means for transmitting and receiving a high-frequency signal for detection of a train within the track segment, and ground-based fixed means for transmitting and receiving a low-frequency signal which constitutes the carrier encoded with the information to be transmitted to train-based receiving units. These signals are transmitted from the ground-based means to the train-based means through the rails of the track segment when the train runs on it.

BACKGROUND OF THE INVENTION

Track circuit design must account for several needs, which may be in contrast with one another. While on the one hand mechanical discontinuities within the rails are undesired, on the other hand electric separation between track circuits is required for detecting train position and for associating each segment with a given information set which generally changes according to the track circuit with to it is related. This balance is achieved with the help of electric joints, which confine the information transmitted through the track to the corresponding particular track segment. Proper consideration should be also given to providing track segments of a given length, while maintaining a low transmission power, and to ensuring that the transmitted signal will not be attenuated due to the low transmission power to such an extent as to be unreadable when received.

The track circuit should operate at such frequencies to be unaffected by traction currents, but the usable frequency bands should also be wide enough to allow transmission of a large amount of information.

Patent EP 771711 B1 discloses a track circuit adapted to transmit information from ground-based units to train-based units through the rails of each isolated track segment, as the train runs on it. The track segments are electrically insulated using S-shaped electric joints, with a compensation network composed of capacitors associated with each track circuit. The addition of such a network of capacitors improves the reliability of the electric joint in transmitting the signal used for train detection through the rails of each track segment while increasing the length of each track segment, and ensures effective confinement of the power associated with each track segment and the transmission of a very large amount of data while still maintaining a high safety level.

Nevertheless, the track circuit disclosed in EP 771711 B1 only operates at high frequencies, i.e. in the audio-frequency range from 2 to 20 kHz, and is not suitable for low frequencies, which are generally used in railway applications to transmit codes from the rails to train-based receiving means. Two frequency modulations are usually applied to alternate currents, at 50 Hz and 178 Hz, in order to enable transmission of a larger number of codes, thereby improving safety by providing more complete information to the trains in a shorter time.

Therefore, there exists a yet unfulfilled need for a track circuit that, by means of simple and inexpensive arrangements, can use electric joints, associated to track segments, which can transmit and receive both high and low-frequency signals, thereby allowing both train detection in a track segment by the use of high frequencies, and transmission of codes from the track segments rails to the train and/or vice versa by using low frequencies.

SUMMARY OF THE INVENTION

The invention fulfils the above purposes by providing a track circuit, in which there are means configured to enable/disable the transmission and reception of high-frequency signals, and means configured to enable/disable the transmission and reception of low-frequency signals, these means being actuated alternately.

In a variant embodiment, only a single type of means configured to enable/disable is used for both high and low-frequency signals, but the enabling/disabling state is still alternated, which means that when low-frequency communication is enabled, the high-frequency communication is disabled and vice versa.

Moreover, each electric joint uses internal impedance between the two loops.

The addition of impedance in the electric joint, and particularly of capacitive type impedance, enables the track circuit to operate both at high frequency to detect a train in a track segment, and at low frequency to transmit codes from the track segment rails to the train.

This is made possible by the added impedance, which prevents short circuits between the rails of the electric joint when low-frequency signals are transmitted into the track circuit and which maintains at a negligible level the signal loss introduced when high-frequency signals are transmitted into the track circuit.

In one embodiment, the track circuit of the present invention uses high-frequency signals in the audio-frequency range, from 2 to 20 kHz, and low-frequency signals from 50 to 178 Hz The low-frequency signals may be introduced into the track circuit using the cable that is used for transmission of audio-frequencies, by direct injection into the rails.

There is no directivity in the transmission of low-frequency signals in the range of 50 to 178 Hz, i.e. the power introduced into the rails is symmetrically distributed when the train is far away and as the train approaches the injection point, power increases in the direction of the train.

Moreover, the use of analog-to-digital converters and digital-to-analog converters at the output of the transmitting means and at the input of the receiving means respectively, allows the transmitted and received signals to be encoded as digital signals, adding robustness to the transmitted signals.

For a proper operation of each electric joint and hence of a track circuit constructed according to the principles of the present invention, the enabling/disabling means are configured to enable the high-frequency signal transmitting and receiving means and the low-frequency signal transmitting and receiving means alternately. Thus, when a train is detected within the track circuit, the enabling/disabling means enable the low-frequency signal transmitting and receiving means and disable the high-frequency signal transmitting and receiving means such to allow transmission of track codes to the train.

Conversely, when no train is detected within said track circuit, the enabling/disabling means disable the low-frequency signal transmitting and receiving means and enable the high-frequency signal transmitting and receiving means to allow train detection within the track segment, when a train comes into the corresponding track segment.

In one embodiment, operation of the enabling/disabling means is optimized by including a control unit in the transmitting and receiving means that controls the enabling/disabling means and that sets the enabling/disabling state of the transmitting and receiving means in response to a train detection signal for the track segment of interest.

As described above, the electric joint in a track circuit according to the present invention has an S shape formed of two loops. An impedance, preferably of capacitive type, is connected between such two loops. In two exemplary embodiments, such impedance may have different positions.

The two loops of the joint form two oscillatory circuits and, in a first embodiment, the impedance may be inserted between the two oscillatory circuits, i.e. outside the resonant loop of the electric joint. Therefore the impedance is unaffected by the resonance current of the electric joint and provides minimum signal attenuation for the high-frequency signal range, although any capacitance drop due to a failure would cause an increase of the current circulating within the electric joint, which would be undesired when considering the safety requirements that are applicable to railway applications and impose a maximum limit to the current circulating in an electric joint.

Therefore, the impedance is located in the middle of the conductor that forms the joint and particularly in the middle of the central section of said conductor, oriented perpendicularly to the tracks.

Alternatively, the impedance may be inserted asymmetrically with respect to the two loops of the electric joint. In this embodiment, the impedance is placed within one of the two oscillatory circuits. This solves the problem associated with safety requirements, because it helps in reducing the current circulating in the joint in case of capacitance degradation, although a higher attenuation is introduced for the range of high-frequency signals, but only in the loop with the impedance.

In this case, the impedance is placed in the conductor sections that form the S-shaped joint and are connected to one end of said central section perpendicular to the tracks.

Regardless of the selected configuration, additional advantages may be obtained by accurately tuning the capacitance value associated with the added impedance. The purpose is to obtain an input current for the receiving means which asymptotically tends to constant values, as a function of track segment length.

As described above, attenuation of high frequency signals should be as low as possible, but care should be taken to avoid dangerous increases in the current circulating in the joint, which requires the impedance to be tuned according to the selected configuration of the electric joint.

Studies and simulations show that if the capacitive impedance is inserted between the two loops of the joint, then a capacitance value of about 75 microfarads will provide an input current to the receiving means that asymptotically tends to constant value.

Conversely, if the capacitive impedance is inserted asymmetrically with respect to the two loops of the electric joint, the capacitance values of the impedance, required to obtain an input current for the receiving means that asymptomatically tends to constant value, are about 1000 microfarads.

Different embodiments of the invention include a variety of features that further improve a track circuit according to the invention, as recited in the appended claims.

BRIEF DESCRIPTION OF THE DRAWINGS

These and other features and advantages of the invention will be more apparent from the following description of a few embodiments shown in the accompanying drawings, in which:

FIGS. 3*a* and 3*b* show equivalent circuits of two possible configurations of electric joints for a track circuit according to the present invention, which are illustrated in FIGS. 4*a* and 4*b;*

DETAILED DESCRIPTION OF EMBODIMENTS OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
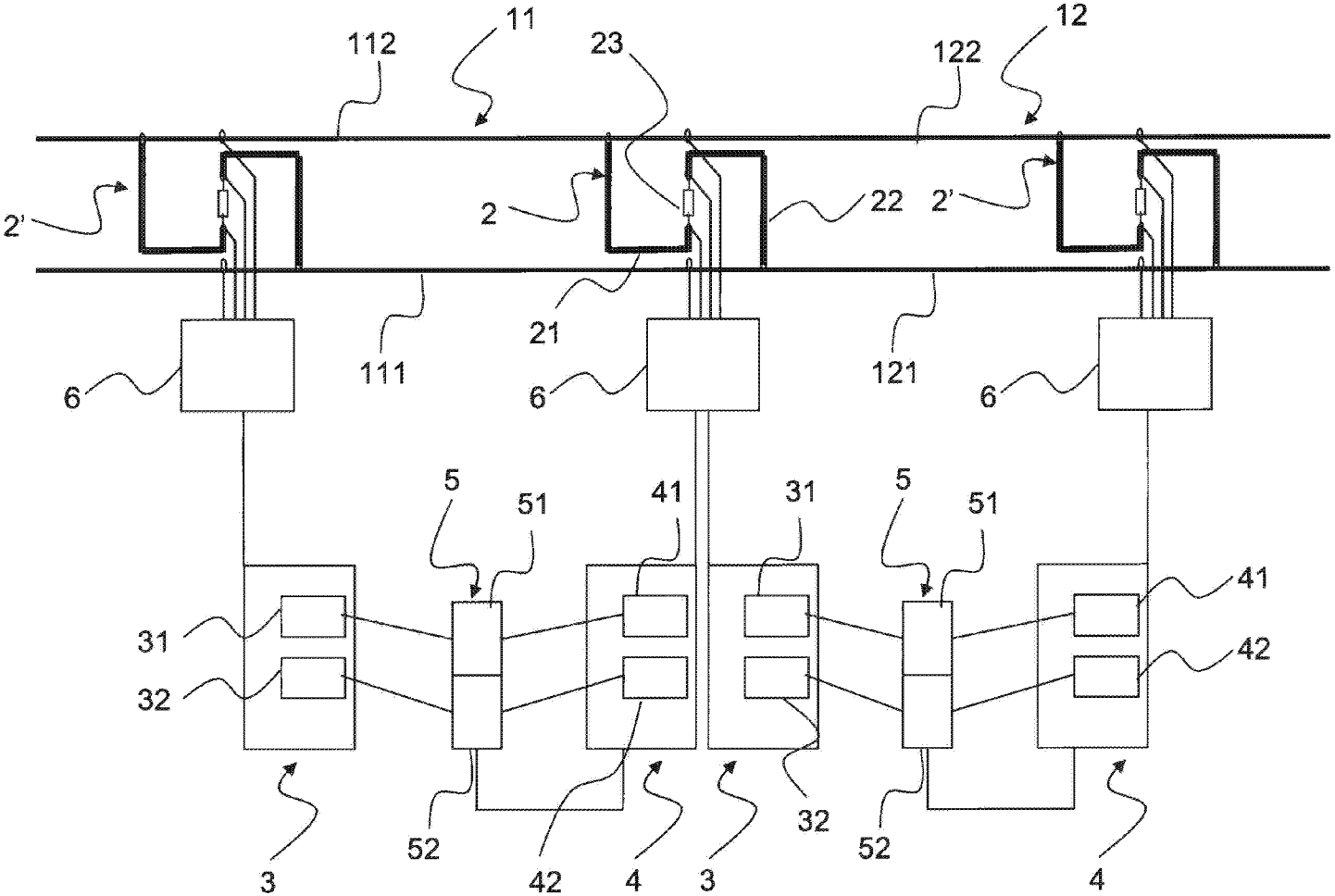
FIG. 1 shows an embodiment of a track circuit according to the present invention.

FIG. 1 shows a track circuit for railway systems or the like, which comprises two adjacent track segments 11 and 12 of predetermined length, each track segment 11 and 12 being electrically insulated from the track segment adjacent thereto by using electric joints 2 and 2'.

Each electric joint 2 and 2' consists of a conductor, which connects together rails 111, 112, 121 and 122 at the ends of track segments 11 and 12 and forms two loops 21 and 22 arranged in an S-shape in the space between said rails 111, 112, 121 and 122. The S lies in the direction of the track axis and has arms extending in the direction of the track, arranged along the inner sides of rails 111, 112, 121 and 122. Therefore, each joint defines the boundaries of the track circuits for adjacent track segments, and referring to FIG. 1 the joint 2 forms the end of the track segment 11 and the start of track segment 12.

Still referring to FIG. 1, each joint 2 and 2' has an impedance 23 connecting the two loops 21 and 22, which is preferably but without limitation a capacitive impedance.

Each joint has connected thereto a receiving unit (or means) for the track segment, of which the joint is the end, and a transmitting unit (or means) for the track segment, of which the joint is the start. FIG. 1 also shows transmitting unit (or means) 3 and receiving unit (or means) 4, which are connected upstream and downstream of impedance 23, so that receiving means 4 for track segment 11 and transmitting means 3 for track segment 12 are connected to the ends of impedance 23.

In the embodiment shown in FIG. 1, a tuning box, designated by numeral 6, may be used.

Transmitting means 3 and receiving means 4 include a ground-based fixed transmitting unit (or means) 31 and a receiving unit (or means) 41 for transmitting and receiving a high-frequency signal for detection of a train within track segments 11 and 12, and a ground-based fixed transmitting unit (or means) 32 and a receiving unit (or means) 42 for transmitting and receiving a low-frequency signal, which constitutes the carrier encoded with the information to be transmitted to train-based receiving units (not shown). Those signals are transmitted from the ground-based means to the train-based means through the rails of track segments 11 and 12, when the train runs on them.

High-frequency signal transmitting means 31 and receiving means 41 transmit and receive a signal in the audio-frequency band, preferably at a range of frequencies from 2 to 20 kHz, while low-frequency transmitting means 32 and receiving means 42 transmit and receive a signal in the frequency range from 50 to 178 Hz.

In one embodiment, the signals transmitted and received by transmitting means 3 and receiving means 4 are digital signals, in which case analog-to-digital converter means and digital-to-analog reconverter means are provided at the output of said transmitting means 3 and at the input of receiving means 4.

Still referring to FIG. 1, in a preferred embodiment of a track circuit according to the present invention, high-frequency signal transmitting means 31 and receiving means 41 are combined with enabling/disabling means 51, which enable or disable transmission and reception of the transmitting means 31 and receiving means 41 for the same track segment 11 and 12.

Likewise, low-frequency signal transmitting means 32 and receiving means 42 are combined with enabling/disabling means 52, which enable or disable transmission and reception of transmitting means 32 and receiving means 42 for the same track segment 11 and 12.

Enabling/disabling means 51 and 52 are provided alternately to each other, such that if enabling/disabling means 51 enable reception and transmission by high-frequency signal transmitting means 31 and receiving means 41, low-frequency signal transmitting means 32 and receiving means 42 are disabled by enabling/disabling means 52 and vice versa.

As described in greater detail in the next figures, the presence of a train in the track circuit will cause low-frequency signal transmitting means 32 and receiving means 32 to be enabled, and as a result, high-frequency signal transmitting means 31 and receiving means 41 to be disabled. In this case, in an embodiment of the track circuit of the present invention, a control unit 5 for controlling the enabling/disabling means will set the enabling/disabling state of high-frequency transmitting means 31 and receiving means 41, and of low-frequency transmitting means 32 and receiving means 42, as a function of the train detection signal for the track segment.

Figure 2A:
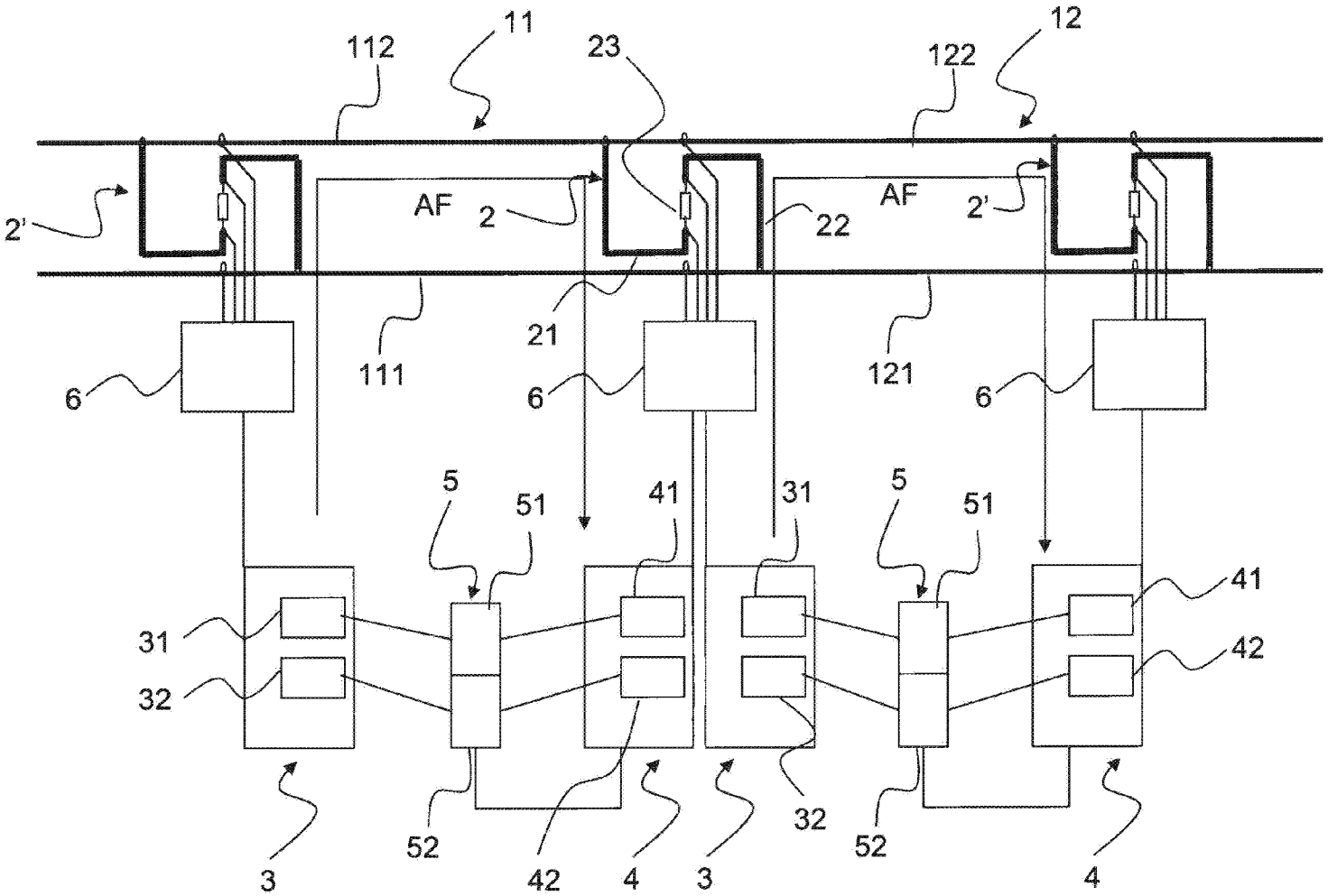
FIGS. 2*a* to 2*c* show the operation of the track circuit of FIG. 1.
Figure 2B:
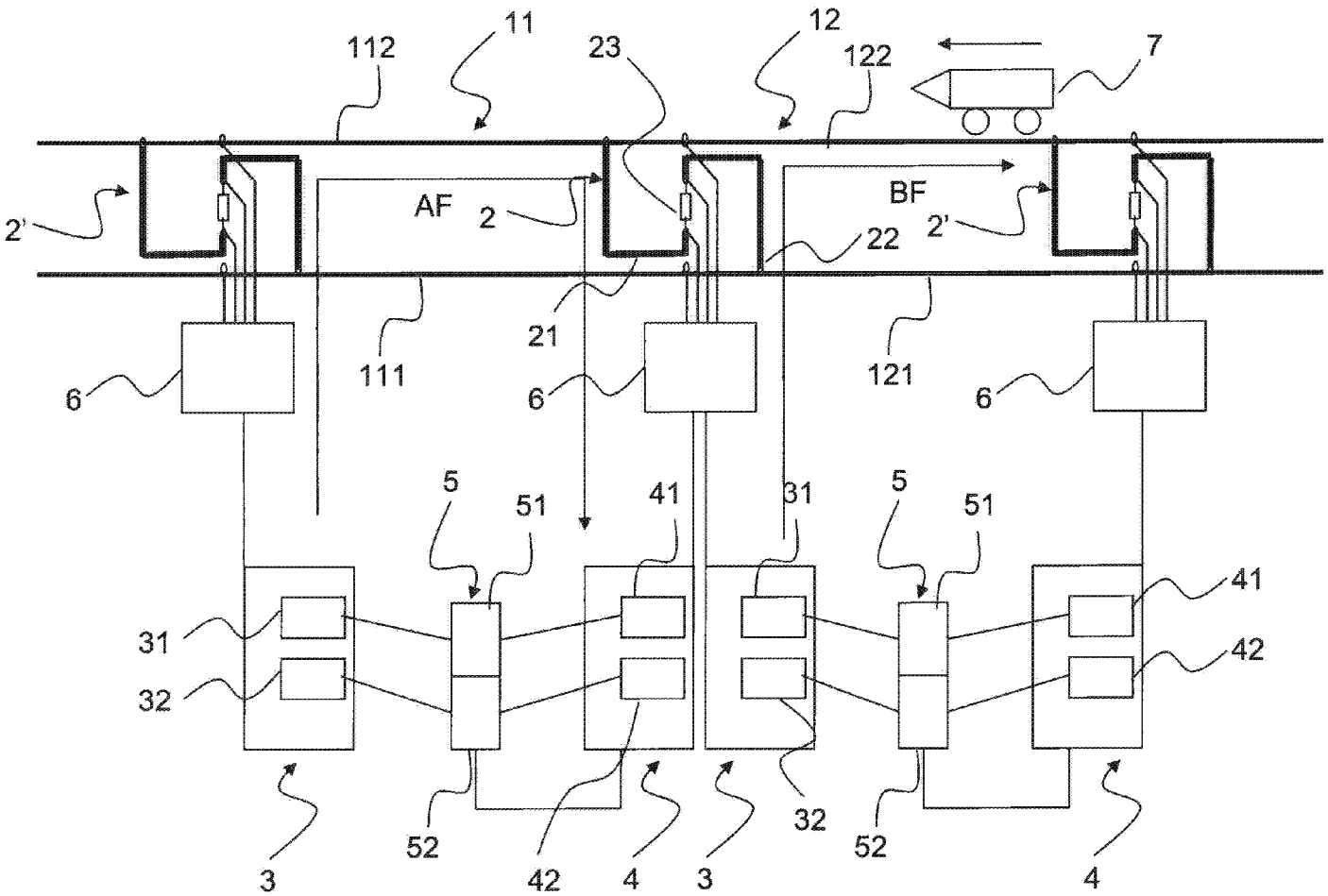
Figure 2C:
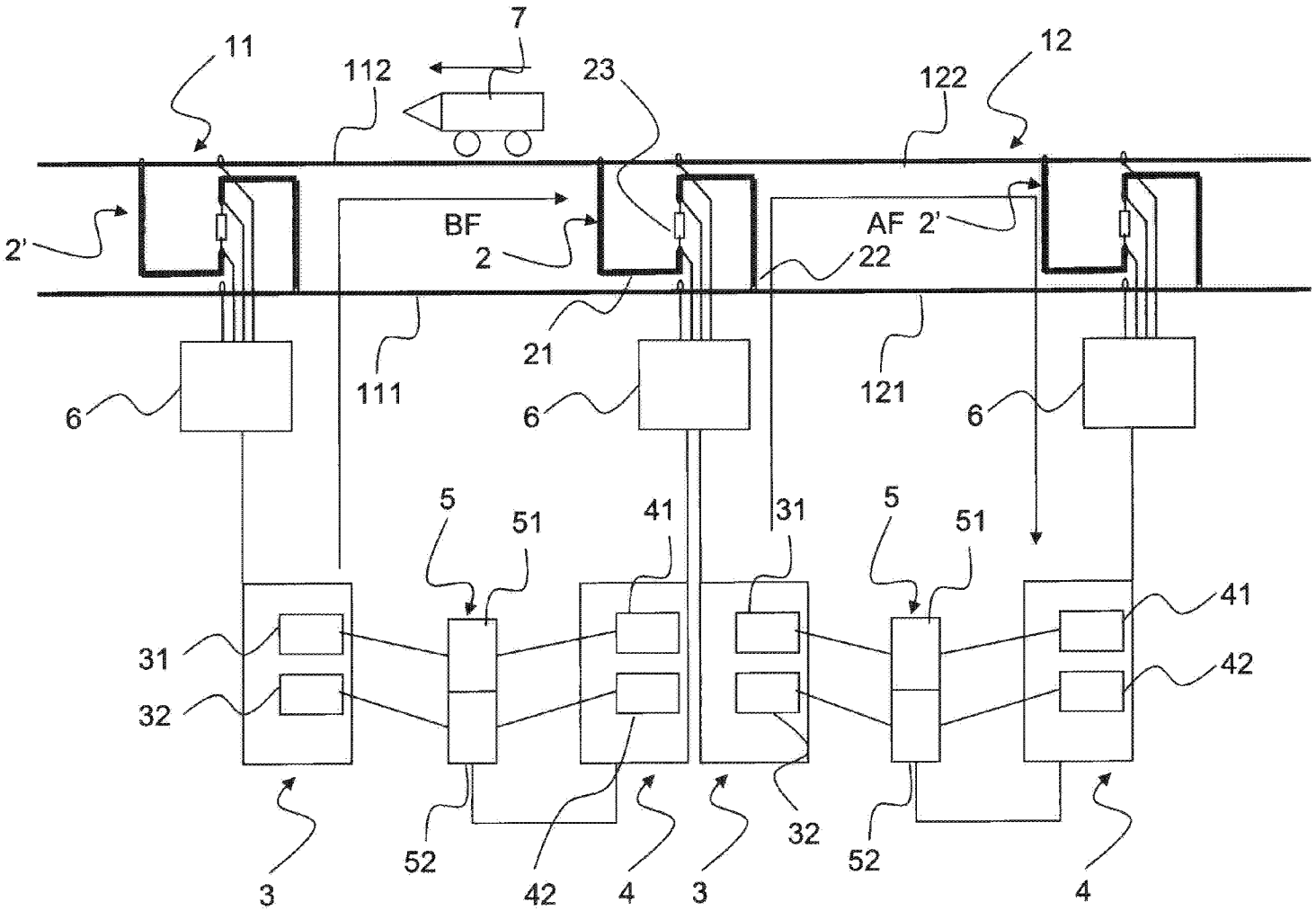

FIGS. 2*a* to 2*c* show the operation of a track circuit according to the present invention.

In particular, FIGS. 2*a* to 2*c* show the track circuit as described above, which consists of two adjacent track segments 11 and 12 of predetermined length, electrically insulated by electric joints 2 and 2'.

Electric joints 2 and 2' consist of a conductor, use an impedance 23 and are connected to transmitting means 3 and the receiving means 4. Transmitting means 3 and receiving means 4 include high-frequency signal transmitting means 31 and receiving means 41, and low-frequency transmitting means 42 and receiving means 32, whose actuation is controlled by enabling/disabling means 51 and 52.

More particularly, FIG. 2*a* shows a condition, in which there is no train in track segments 11 and 12, and in which transmitting and receiving means 3 and 4 for the track segment 11 detect no train, and control unit 5 sets the state of the enabling/disabling means 51 and 52 for high-frequency signal transmitting means 31 and receiving means 41 to be enabled, and low-frequency signal transmitting means 31 and receiving means 42 to be disabled.

The same state is found in track segment 12, i.e. communication both in track segment 11 and in track segment 12 occurs via high-frequency signals, designated as AF, and electric joints 2 and 2' can both electrically insulate track segments 11 and 12 and allow such high-frequency communication without any significant signal loss.

In FIG. 2*b*, a train 7 comes into the circuit formed by track segment 12. In this event, transmitting and receiving means 3 and 4 for track segment 11 detect no train and control unit 5 sets the state of enabling/disabling means 51 and 52 for high-frequency signal transmitting means 31 and receiving means 41 to be enabled, and low-frequency signal transmitting means 32 and receiving means 42 to be disabled. Such system will still transmit high-frequency signals, designated as AF.

However, in track segment 12, train 7 shorts by its axles rails 121 and 122 and hence is detected by transmitting means 3 and receiving means 4.

Control unit 5 sets the state of enabling/disabling means 51 and 52 for low-frequency signal transmitting means 32 and receiving means 42 to be enabled and high-frequency signal transmitting means 31 and receiving means 41 to be disabled. The circuit for track segment 12 transmits a low-frequency signal, designated as BF, which provides the carrier to be encoded with the information to be transmitted to the receiving units in train 7, those signals being transmitted by ground-based transmitting means 32 to the train-based means through rails 121 and 122 of track segment 12.

Thus, electric joints 2 and 2' not only electrically insulate track segments 11 and 12 but also allow communication via low-frequency signals, through impedance 23, by maintaining a short-circuit state between rails 121 and 122.

In FIG. 2*c*, train 7 has moved past track segment 12 and runs on track segment 11. Train 7 no longer shorts rails 121 and 122, and its absence is detected by transmitting means 3 and receiving means 4, which use control unit 5 and enabling/disabling means 51 and 52 to transmit the enabling state for high-frequency signal transmitting means 31 and receiving means 41, and the disabling state for low-frequency signal transmitting means 32 and receiving means 42, thereby restoring the initial condition for track segment 12 as shown in FIG. 2*a*.

However, in track segment 11, train 7 shorts by its axles rails 111 and 112 and hence is detected by transmitting means 3 and receiving means 4.

Control unit 5 sets the state of enabling/disabling means 51 and 52 for low-frequency signal transmitting means 32 and receiving means 42 to be enabled and for high-frequency signal transmitting means 31 and receiving means 41 to be disabled. The circuit for track segment 11 transmits a low-frequency signal, designated as BF, which provides the carrier to be encoded with the information to be transmitted to the receiving units in train 7, those signals being transmitted by ground-based transmitting means 32 to the train-based means through rails 111 and 112 of track segment 11.

Like before, electric joints 2 and 2' not only electrically insulate track segments 11 and 12 but also allow communication via low-frequency signals, through impedance 23, by maintaining a short-circuit state between rails 111 and 112.

Once train 7 completes its run on track segment 11, communication occurs in track segments 11 and 12 via high-frequency signals, thereby restoring the initial state as shown in FIG. 2*a*.

FIGS. 3*a* and 3*b* show two possible configurations of electric joints for the track circuit of the present invention.

In particular, FIG. 3*a* shows a possible embodiment of electric joint 2 for the track circuit of the present invention.

The electric joint 2 is composed of two half-joints 21 and 22 which form the two loops of the S shape of the joint. Each half-joint 21, 22 forms an oscillatory circuit, with a capacitive impedance 23 inserted between the two oscillatory circuits 21 and 22.

Thus, impedance 23 is placed outside the resonant loop of electric joint 2 and is hence unaffected by the resonance current of the joint.

As described above, capacitive impedance 23 of FIG. 3*a* should assume values of about 75 microfarads to obtain an input current for the receiving means that asymptotically tends to constant values.

FIG. 3*b* shows an alternative embodiment of electric joint 2. Here, impedance 23 is asymmetrically connected with respect to the two loops of joint 21 and 22 and hence is placed within one of the two oscillatory circuits, in particular, in the oscillatory circuit that forms loop 21.

Joint 2 as depicted in FIG. 3*b* should assume values of about 1000 microfarads to obtain an input current for the receiving means that asymptotically tends to constant values.

Figure 4B:
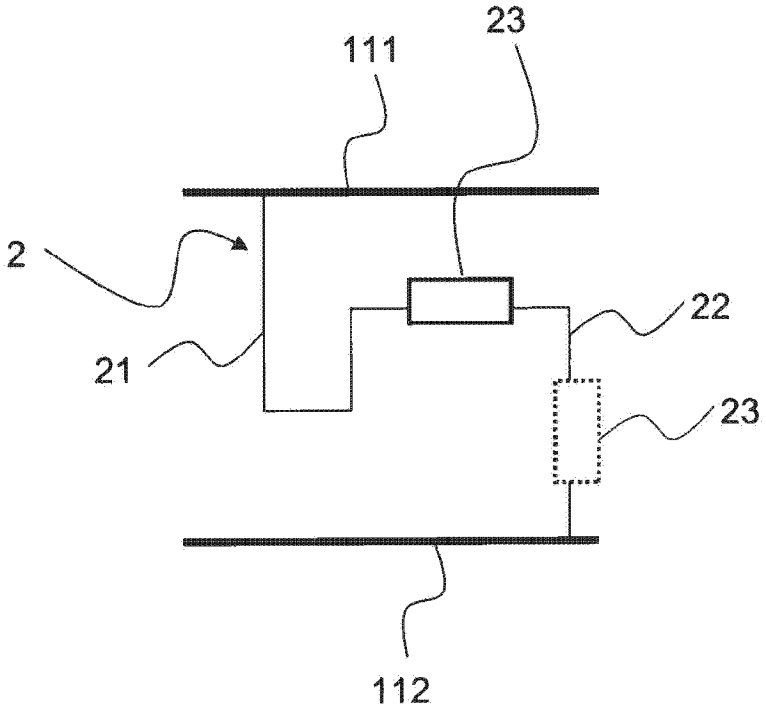
FIGS. 4*a* and 4*b* show the electric joints of two possible configurations of the equivalent circuits of FIGS. 3*a* and 3*b.*
Figure 4A:
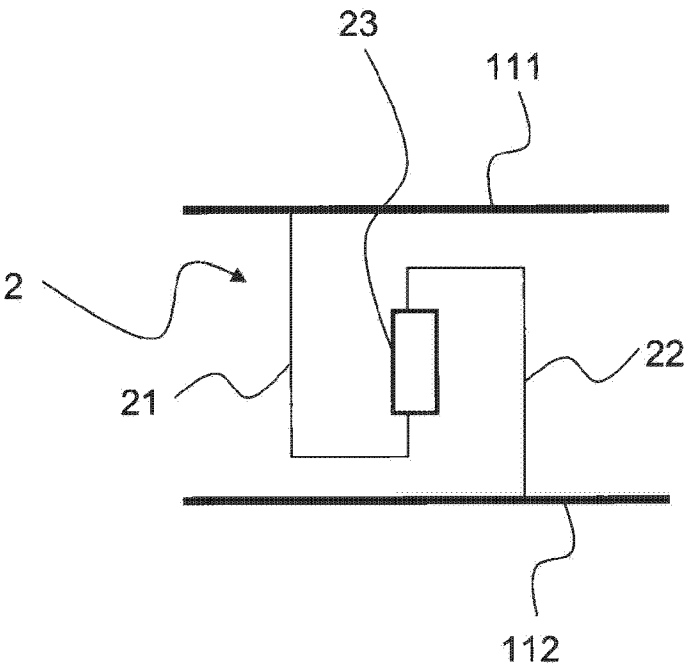

FIGS. 4*a* and 4*b* show the electric joints of the two possible configurations of the circuits of FIGS. 3*a* and 3*b*.

In FIG. 4*a*, electric joint 2 is composed of two half-joints 21 and 22 that form the two loops of the S shape of the joint. In this embodiment, an impedance 23 is inserted in a middle area of the conductor that forms joint 2 and more particularly at the center of the middle section of said conductor, which is oriented perpendicular to tracks 111 and 112.

In FIG. 4*b*, electric joint 2 is composed of two half-joints 21 and 22 that form the two loops of the S shape of the joint. In this embodiment, an impedance 23 is inserted in one of the two conductor sections that form the S-shaped joint and that are connected to one end of said middle section of the conductor, which is oriented perpendicular to tracks 111 and 112.

In FIG. 4*b*, impedance 23 is located in section 221 parallel to track 112 of loop 22, although in variant embodiments impedance 23 might be placed either in section 222 perpendicular to track 112 of loop 22, as shown by broken lines, and in the section parallel or perpendicular to track 112 of loop 21.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become apparent to those skilled in the art and is limited only by the appended claims.

What is claimed is:

1. A track circuit for railway systems comprising:

a track segment of predetermined length and a plurality of track segments forming a railway;

an electric joint connecting an end of the track segment to an end of an adjacent track segment, the electric joint comprising a conductor and being configured to electrically insulate the track segment from the adjacent track segment, the electric joint comprising two loops arranged in an S-shape and disposed longitudinally in a space between rails, the S-shape comprising arms extending toward the rails;

a transmitting unit which transmits electric signal and a receiving unit each operatively coupled to the electric joint, the electric joint having connected thereto the transmitting unit and the receiving unit of the track segment and the transmitting unit and the receiving unit of the adjacent track segment;

a ground-based transmitting unit comprised within the transmitting unit and a ground-based receiving unit comprised within the receiving unit, the ground-based transmitting and receiving units being configured to transmit and respectively receive high-frequency signals for detection of a train on the track segment;

a second ground-based transmitting unit comprised within the transmitting unit and a second ground-based receiving unit comprised within the receiving unit, the second ground-based transmitting and receiving units being configured to transmit and respectively receive low-frequency signals forming a carrier encoded with information to be transmitted to a receiving unit in the train, wherein the high- and low-frequency signals are transmitted from the ground-based units to the train-based unit through the rails comprising the track segment when the train runs on the track segment;

an enabling/disabling unit configured to alternately enable/disable the high-frequency signal transmitting and receiving units, and an enabling/disabling unit configured to enable/disable the low-frequency signal transmitting and receiving units; and an impedance disposed within the electric joint.

2. The track circuit of claim 1, wherein the impedance is of a capacitive impedance.

3. The track circuit of claim 2, wherein the high-frequency signals are in a frequency range from 2 to 20 kHz, and wherein the low-frequency signals are in a frequency range from 50 to 178 Hz.

4. The track circuit of claim 1, wherein the enabling/disabling units enable the low-frequency signal transmitting and receiving units and disable the high-frequency signal transmitting and receiving units when a train is detected within the track circuit, and disable the low-frequency signal transmitting and receiving units and enable the high-frequency signal transmitting and receiving units when no train is detected within the track circuit.

5. The track circuit of claim 1, wherein transmitting unit and receiving units are operatively coupled to a control unit configured to control the enabling/disabling units, such to set an enabling/disabling state of the transmitting and receiving units as a function of the train detection signal for the track segment.

6. The track circuit of claim 1, wherein the track circuit is configured to encode the transmitted and received signals as digital signals.

7. The track circuit of claim 1, wherein the impedance is disposed between the two loops of the S-shape of the electric joint.

8. The track circuit of claim 1, wherein the impedance is disposed asymmetrically with respect with the two loops of the S-shape of the electric joint.

9. The track circuit of claim 1, wherein a capacitance value in each electric joint is determined by a value of the impedance such that current within the receiving unit asymptotically tends to constant values in relation to a length of the track segment.

10. The track circuit of claim 1, wherein capacitance of the electric joint is from 50 to 100 microfarads.

11. The track circuit of claim 1, wherein capacitance of the electric joint is from 800 to 1200 microfarads.

* * * * *